US005419543A

United States Patent [19]

Nakamura et al.

[11] Patent Number: 5,419,543

[45] Date of Patent: May 30, 1995

[54] PAPER FEEDING APPARATUS FOR PRINTER

[75] Inventors: Shinya Nakamura; Yoshiaki Tanaka, both of Shizuoka, Japan

[73] Assignee: Tokyo Electric Co., Ltd., Tokyo, Japan

[21] Appl. No.: 94,899

[22] Filed: Jul. 22, 1993

[30] Foreign Application Priority Data

Jul. 22, 1992 [JP] Japan ..... 4-195381
Jul. 22, 1992 [JP] Japan ..... 4-195384

[51] Int. Cl.[6] ..... B65H 3/44

[52] U.S. Cl. ..... 271/9; 271/118; 271/127; 271/114; 271/116; 74/354; 400/624

[58] Field of Search ..... 271/9, 117, 118, 114, 271/116, 126, 127; 74/354; 400/624, 625, 629

[56] References Cited

U.S. PATENT DOCUMENTS

| | | | |
|---|---|---|---|
| 3,183,735 | 5/1965 | Boreen et al. | 74/354 |
| 4,535,982 | 8/1985 | Mochimaru | 271/127 |
| 4,728,963 | 3/1988 | Rasmussen et al. . | |
| 4,770,555 | 9/1988 | Deschamps et al. | 400/624 |
| 5,026,641 | 6/1991 | Kitazume et al. | 271/118 |
| 5,069,434 | 12/1991 | Sellers | 271/126 |
| 5,199,695 | 9/1993 | Nakahata et al. | 271/127 |
| 5,213,426 | 5/1993 | Ewing | 271/114 |

FOREIGN PATENT DOCUMENTS

| | | | |
|---|---|---|---|
| 58123840 | 8/1983 | Japan . | |
| 00022738 | 1/1989 | Japan | 271/114 |
| 4016428 | 1/1992 | Japan | 271/117 |

*Primary Examiner*—H. Grant Skaggs
*Attorney, Agent, or Firm*—Oblon, Spivak, McClelland, Maier, & Neustadt

[57] ABSTRACT

A paper feeding apparatus of the present invention, in which it is adapted such that a paper tray holding plural sheets of paper in a pile is supported by a fulcrum for rotation round the same and the paper tray is rotated by a paper setting mechanism so that the topmost copy paper of the paper held in the paper tray is brought into abutment with a feed roller and fed to a printing portion. As the drive power source of the paper setting mechanism and the feed roller, a constituent of a paper feeding mechanism, is used only a single motor rotatable in both normal and reverse directions. The normal or reverse rotation of the motor is selectively transmitted by a drive gear mechanism to the paper setting mechanism or the paper feeding mechanism, and thereby, it is made possible to selectively drive either the paper setting mechanism or the paper feeding mechanism using only a single motor. Thus, it is made possible to make the apparatus smaller and to reduce the cost of parts.

9 Claims, 11 Drawing Sheets

PAPER FEEDING APPARATUS FOR PRINTER

BACKGROUND OF THE INVENTION

1. Field of the Invention

The present invention relates to a paper feeding apparatus for printer for feeding the copy paper held in a paper tray to a printing portion.

2. Description of the Related Art

As an apparatus of the described type for use for example in an ink jet printer, there has been known one in which paper held in a paper tray is brought into abutment with a feed roller by rotation of the paper tray round its fulcrum so that the paper is fed to the printing head by means of the rolling friction of the feed roller and printed by the printing head. General arrangement of an example of the apparatus with the described arrangement is shown in FIG. 11 to FIG. 13.

In a printer body 1, there are disposed in predetermined positions a printing head 3 as the ink jet head, a paper setting mechanism 10, and a paper feeding mechanism 20.

The paper setting mechanism 10 includes a paper tray 11 arranged in the printer body 1 for rotation round a fulcrum 12 and having a paper holding portion 80 holding plural sheets of paper. The paper setting mechanism 10 is arranged to set paper in a feeding position by rotating the paper tray 11 in the direction of the arrow F a predetermined angle from the standby position shown in FIG. 11 thereby bringing the paper held in the paper tray 11 into abutment with a feed roller 21. More specifically, the paper setting mechanism 10 includes, other than the paper tray 11, a spring 13 which urges the paper tray 11 toward the feed roller 21 so that the topmost sheet of paper held in the paper tray 11 abuts on the feed roller 21 and a cam member 14 which, by being rotated in a predetermined direction (for example, in a clockwise direction), presses the paper tray 11 through a cam-contacted surface 11*c*, against the urge of the spring 13, so that the paper tray 11 is rotated in the direction to go away from the feed roller 21. The cam member 14 is generally formed of a synthetic resin for easiness of its fabrication and other reasons.

The paper setting mechanism 10 is driven by a drive mechanism for paper setting 30 shown in FIG. 12. The drive mechanism for paper setting 30 includes a paper setting motor 31 and a gear train (a pinion gear 32 and a cam gear 33) for transmitting the driving force of the paper setting motor 31 to the cam member 14 so that the cam member 14 is rotated in the clockwise direction in the drawing. Therefore, by rotating the cam member 14 a predetermined angle in the clockwise direction using the drive mechanism for paper setting 30, the paper held in the paper tray 11 can be brought into contact with the feed roller 21 or separated therefrom. The position of the cam member 14 is detected by a cam sensor, not shown, and, it is adapted such that the position of the paper and the paper tray 11 can be determined according to the result of the detection.

The paper feeding mechanism 20 is arranged so as to feed the paper to a position confronting the printing head 3. In concrete terms, the paper feeding mechanism 20, as shown in FIG. 11 and FIG. 13, includes the feed roller 21 and a leaf plate 23 to press the paper against the feed roller 21.

The paper feeding mechanism 20 is driven by a drive gear mechanism for paper feeding 40 shown in FIG. 12. The drive gear mechanism for paper feeding 40 includes a paper feeding motor 41 and a gear train (a pinion gear 42, intermediate gears 43, 44, and 45, and a driven gear 46) for transmitting rotating power of the paper feeding motor 41 to the feed roller 21. Accordingly, when the paper tray 11 having the paper in its set state (where the topmost sheet of paper held in the paper tray 11 is in abutment with the feed roller 21) as shown in FIG. 13, if the paper feeding motor 41 of the drive gear mechanism for paper feeding 40 is driven so that the feed roller 21 is rotated clockwise, the topmost sheet of paper is fed by the feed roller 21 and transported to the ink jet head 3.

After the top end of the copy paper fed out of the paper tray 11 has reached the leaf plate 23, the paper setting motor 31 is driven so that the paper tray 11 is rotated downward and positioned in its standby position shown in FIG. 11. The paper picked up between the leaf place 23 and the feed roller 21 is fed to the printing head 3 and it, after being printed, is delivered to a paper receiving portion 7 by a delivery roller 5 and a pinch roller 6.

The portion of the paper tray 11 coming into contact with the feed roller 21 is precisely finished into a plane surface and, in addition, provided with a high friction coefficient by having cork or the like attached thereto so that the final sheet of paper can be given a sufficient frictional force. The whole body of the paper tray 11, while it is designed to be small and light, is formed of a highly rigid material to prevent the paper from unevenly abutting on the feed roller 21. It is usually formed of an aluminum die casting. Thus, the paper tray 11 is prevented from deforming in the direction rectangular to the paper feed direction or the like and, thereby, the paper tray 11 is pressed against the feed roller 21 with uniform pressure. As a result, the paper held in the paper tray 11 is prevented from making for example diagonal movement and hence it is smoothly fed. Further, the cam-contacted surface 11*c* of the paper tray 11 is formed of a sliding material (for example, a synthetic resin) separate from the paper tray 11 so that the cam member 14 formed of a synthetic resin may not be worn out in a short period of time.

Problems in such related art will be described below. In the field of printers such as ink jet printers, there have recently been great demands for apparatus in smaller size. Accordingly, attempts are being made, concerning the paper feeding apparatus for the printer, to make the bulky constituents, such as the drive mechanism for paper setting 30 and the drive gear mechanism for paper feeding 40, into smaller size or to change layout of these mechanisms so as to save installing space of them. However, there is a problem that the demands for smaller-sized apparatus cannot fully be met by such designating. Also, it is a problem that cost for parts is high because two independent systems are required for the drive system of the drive mechanism for paper setting 30 and the drive system of the drive gear mechanism for paper feeding 40.

SUMMARY OF THE INVENTION

An object of the present invention is to provide a paper feeding apparatus for a printer which can be made smaller in size.

Another object of the present invention is to provide a paper feeding apparatus for a printer which can be reduced in cost of parts.

According to the present invention, there is provided a paper feeding apparatus in which a paper tray holding plural sheets of paper in a pile is disposed for rotation round a fulcrum and a feed roller is disposed in a position where the topmost paper of the paper held in the paper tray can contact-the same, and it is adapted such that the paper tray is rotated by a paper setting mechanism so that the paper holding portion of the paper tray is moved toward or away from the feed roller. There is used only a single motor rotatable in both normal and reverse directions as the drive power source of a paper setting mechanism and the feed roller, a constituent our a paper feeding mechanism. The motor is selectively rotated either in the normal direction or in the reverse direction, and the normal or reverse rotation of the motor is selectively transmitted by a drive gear mechanism either to the paper setting mechanism or the paper feeding mechanism. Thereby, it is made possible to selectively drive either the paper setting mechanism or the paper feeding mechanism using only one motor. Thus, it is made possible to make the apparatus smaller and reduce the cost of parts.

DETAILED DESCRIPTION OF THE PREFERRED EMBODIMENTS

Figure 1:
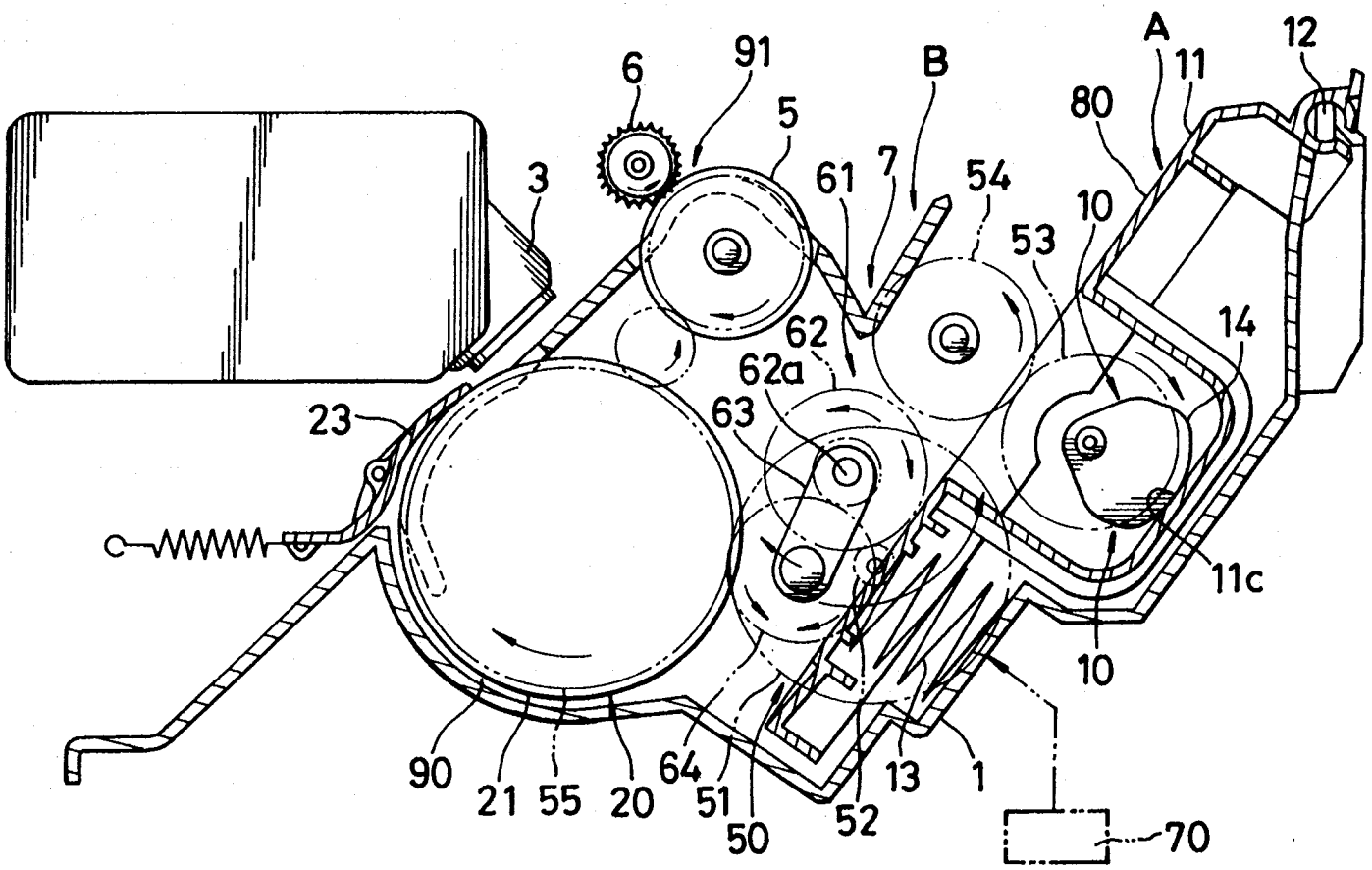
FIG. 1 is a side view in longitudinal section showing the whole of a first embodiment of the present invention.
Figure 11:
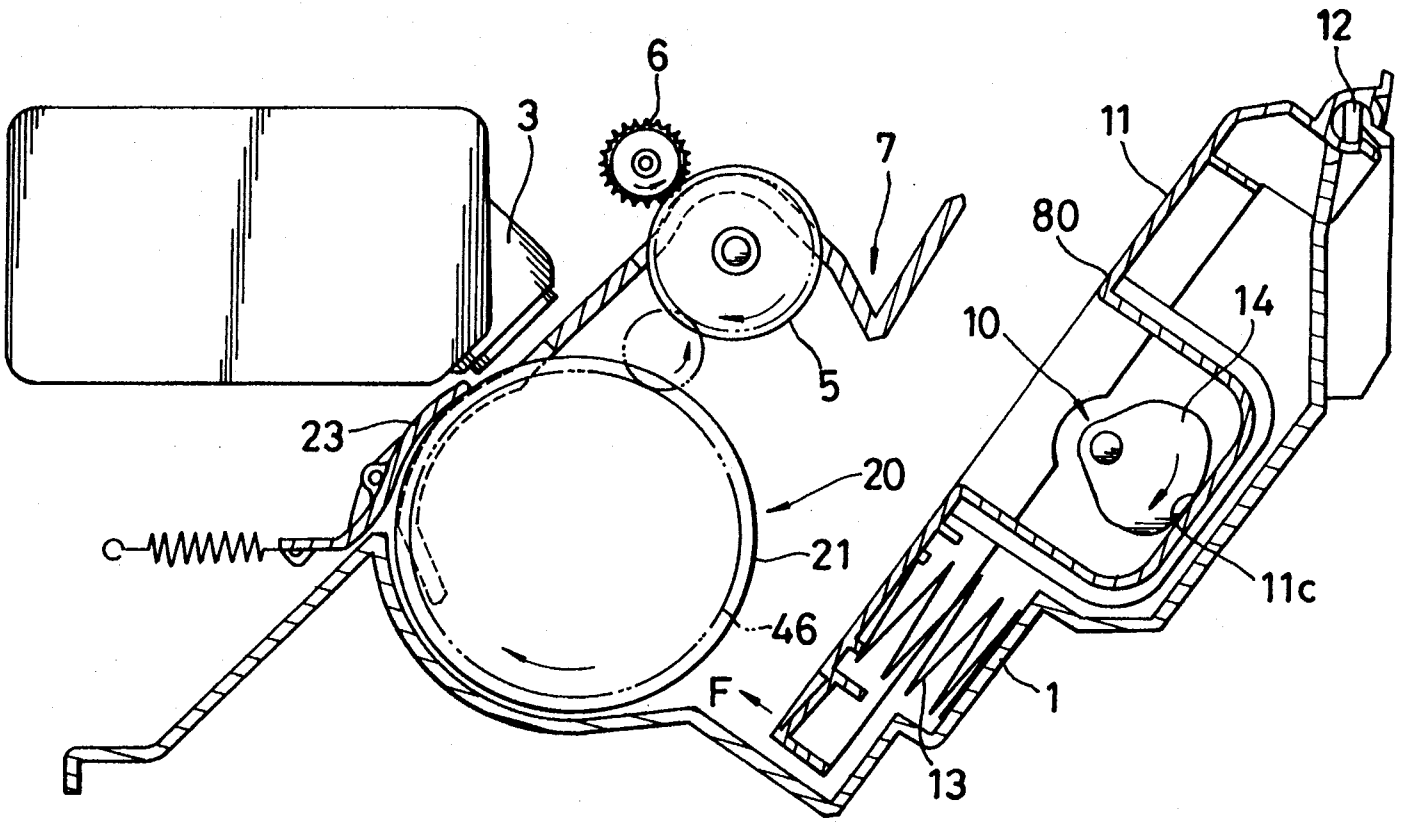
FIG. 11 PRIOR ART
FIG. 11 is a side view in longitudinal section of an example of a paper feeding apparatus for printer of a related art, in which a paper tray is in its standby position.
Figure 12:
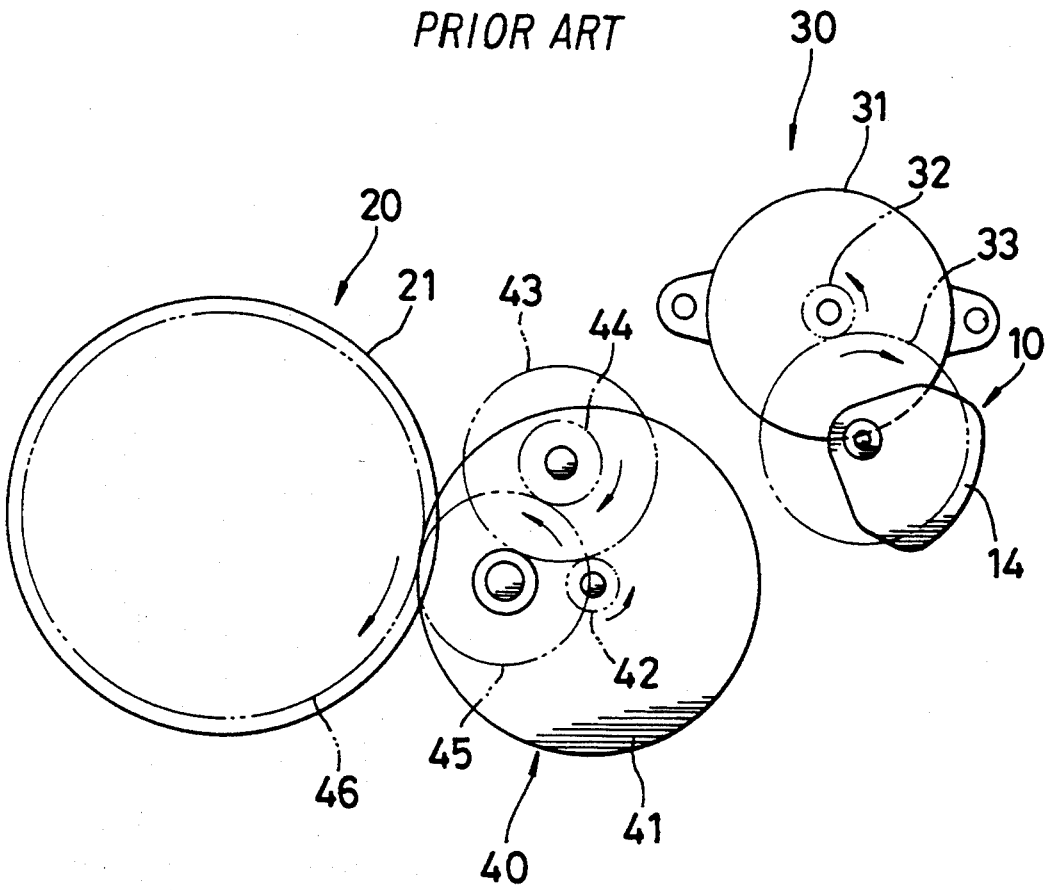
FIG.12 PRIOR ART
FIG. 12 is a side view showing a drive mechanism for paper setting and a drive gear mechanism for paper feeding.
Figure 13:
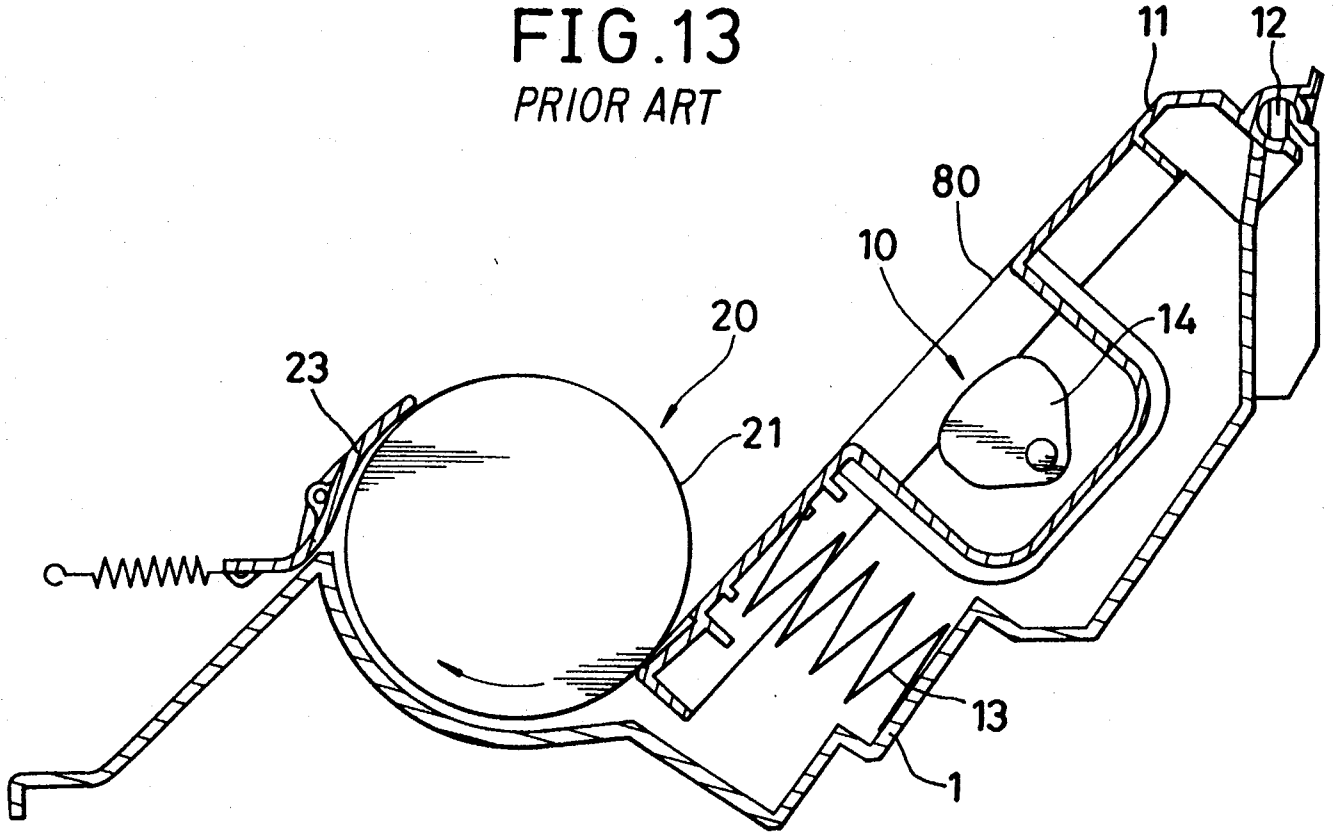
FIG.13 PRIOR ART
FIG. 13 is a side view in longitudinal section of the paper feeding apparatus, in which the paper tray has its paper in its set position.

A first embodiment of the present invention will be described below with reference to FIG. 1 and FIG. 2, in which corresponding parts to those shown in FIG. 11 to FIG. 13 are denoted by corresponding reference numerals. The present embodiment is that applied to an ink jet printer. First, in the printer body 1, there is formed a paper guiding path 90 in the shape of the letter U for guiding the paper along a predetermined path from a paper feeding position A to a paper delivery position B. In the paper guiding path 90 from the paper feeding position A to the paper delivery position B, there are arranged a paper setting mechanism 10, a paper feeding mechanism 20, a printing head 3, a paper delivery mechanism 91, and a paper receiving portion 7 in the order named. Also in the printer body 1, there is provided, in a predetermined position, a drive gear mechanism 50 for driving the paper setting mechanism 10 and the paper feeding mechanism 20 through normal and reverse rotations of one motor 51 and, further, there is incorporated therein a drive control means 70 for causing the motor 51 to make the normal and reverse rotations through predetermined steps of procedure.

The paper setting mechanism 10 includes a paper tray 11 disposed in the paper feeding position A for rotation round a fulcrum 12 and having a paper holding portion 80 for holding plural sheets of paper. The paper setting mechanism 10 is adapted to set the paper in position by rotating the paper tray 11 in the direction of a predetermined angle from the standby position shown in FIG. 1 thereby causing the paper held in the paper tray 11 to abut on the feed roller 21. In concrete terms, the paper setting mechanism 10 includes, other than the paper tray 11, a spring 13 which urges the paper tray 11 toward the feed roller 21 so that the topmost sheet of the paper held in the paper tray 11 abuts on the feed roller 21 and a cam member 14 which, by being rotated in a predetermined direction (for example, in a clockwise direction), presses the paper tray 11, against the urge of the spring 13, through a cam-contacted surface 11*c* so that the paper tray 11 is rotated in the direction going away from the feed roller 21.

The paper feeding mechanism 20 is arranged so as to feed paper to the printing head 3. In concrete terms, the paper feeding mechanism 20 as shown in FIG. 1 includes a feed roller 21 and a leaf plate 23 pressing the paper against the feed roller 21. The printing head 3 is an ink jet head selectively shooting ink droplets at the copy paper guided along the paper guiding path 90 to thereby form predetermined images on the paper. The paper delivery mechanism 91 is formed of a paper delivery roller 5 and a pinch roller 6 arranged to confront each other with the paper guiding path 90 passing therebetween. When the pinch roller 6 abuts on the paper delivery roller 5 which is rotated driven by a driving portion, not shown, a copy paper inserted between the paper delivery roller 5 and the pinch roller 6 is delivered to a paper receiving portion 7 positioned in the paper delivery position B.

Figure 2:
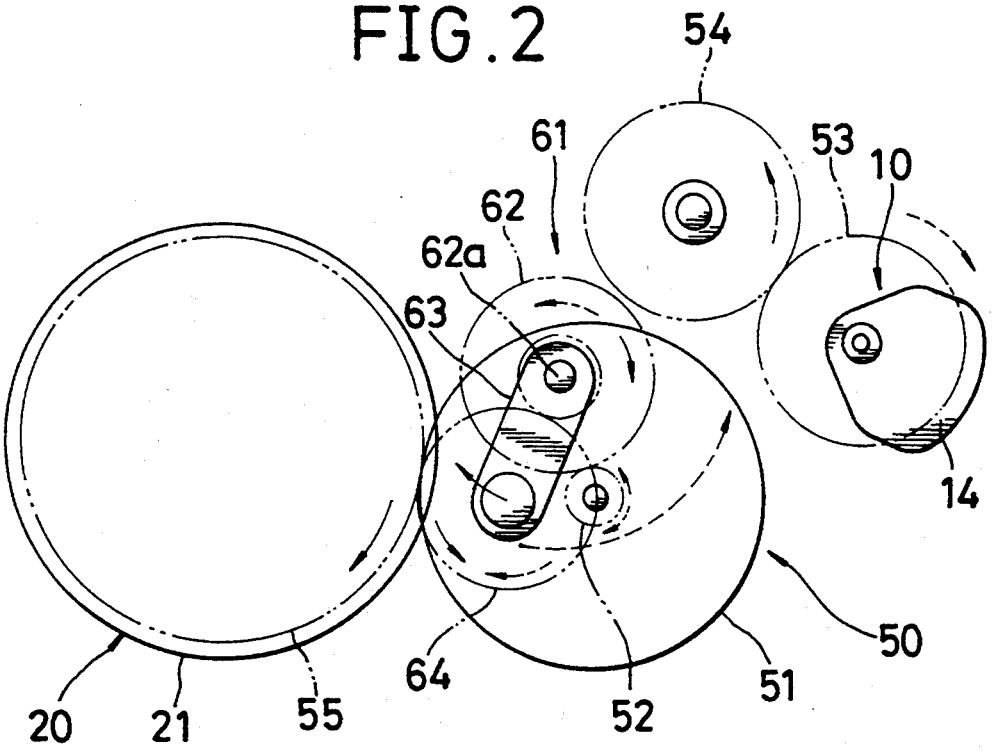
FIG. 2 is a side view of a drive gear mechanism.

The drive gear mechanism 50, as shown in FIG. 2, includes a motor 51, a pinion gear 52 mounted on the revolving shaft of the motor 51, a gear portion on the side of the paper setting mechanism (a cam gear 53 and an intermediate gear 54) normally engaged with the cam member 14 of the paper setting mechanism 10, a gear portion on the side of the paper feeding mechanism (a paper feeding gear 55) normally engaged with the feed roller 21 of the paper feeding mechanism 20, and a selective power transmission portion 61. The selective power transmission portion 61 is adapted, when the motor 51 rotates in the normal direction (in the direction to rotate the pinion gear 52 clockwise in FIG. 2), to engage the pinion gear 52 with the gear portion on the side of the paper setting mechanism (the cam gear 53 and the intermediate gear 54) to thereby transmit the rotating power of the motor 51 to the cam member 14 and, when the motor 51 rotates in the reverse direction (in the direction to rotate the pinion gear 52 counterclockwise), to engage the pinion gear 52 with the gear portion on the side of the paper feeding mechanism (the paper feeding gear 55) to thereby transmit the rotating power of the motor 51 to the feed roller 21. More specifically, the cam gear 53 of the gear portion on the side of the paper setting mechanism is concentrically fixed to the cam member 14, and the intermediate gear 54 is disposed for rotation in a fixed position normally put in engagement with the cam gear 53. Meanwhile, the paper feeding gear 55 of the gear portion on the side off the paper feeding mechanism is concentrically fixed to the feed roller 21. The selective power transmission portion 61 is formed of a sun gear 62 (a power transmission mechanism) normally engaged with the pinion gear 52, a swing member 63 (a selecting mechanism) supported for swinging round the same axis 62*a* as that of the sun gear 62 and adapted to be urged in the same direction as the rotating direction of the sun gear 62 by its rotating power, and a planet gear 64 (a selective engagement gear) supported at the swinging end portion of the swing member 63 for rotation in engagement with the sun gear 62. The sun gear 62 is a double gear having a large gear engaged with the pinion gear 52 and a small gear engaged with the planet gear 64.

Accordingly, when the motor 51 is rotated in the normal direction so that the pinion gear 52 is rotated clockwise, the sun gear 62 of the selective power transmission portion 61 rotates counterclockwise. Hence, the swing member 63 swings counterclockwise so that the planet gear 64 comes into engagement with the intermediate gear 54 of the gear portion on the side of the paper setting mechanism. As a result, the rotating power of the motor 51 is transmitted to the cam member 14 and the cam member 14 is rotated clockwise in FIG. 2. Conversely, when the motor 51 is rotated in the reverse direction so that the pinion gear 52 is rotated counterclockwise in FIG. 2, the sun gear 62 is rotated clockwise. Hence, the swing member 63 swings clockwise so that the planet gear 64 comes into engagement with the paper feeding gear 55. As a result, the rotating power of the motor 51 is transmitted to the feed roller 21 and the feed roller 21 rotates clockwise in FIG. 2.

The drive control means 70 is structured with a portion of a controller, not shown, for controlling drive of the overall electric parts of the printer.

With the described arrangement, when the motor 51 of the drive gear mechanism 50 is controlled by the drive control means 70 to rotate clockwise, the cam member 14 of the paper setting mechanism 10 is rotated so that the paper held in the paper holding portion 80 of the paper tray 11 is brought into abutment with the feed roller 21 and, thereby, the state where the paper is set is brought about. From this state, if the motor 51 is driven to rotate in the reverse direction, the feed roller 21 of the paper feeding mechanism 20 is rotated. Thereby, the paper in abutment with the feed roller 21 is transported in the direction toward the printing head 3.

When the top end of the transported paper reaches the leaf plate 23, the motor 51 is controlled by the drive control means 70 to rotate clockwise. Hence, the cam member 14 rotates clockwise and, thereby, the paper tray 11 is pushed at the cam-contacted surface 11*c* to take up the standby position. Then, the paper inserted between the leaf plate 23 and the feed roller 21 is transported to the printing head 3 and subjected to printing, and then, transported by the paper delivery roller 5 and the pinch roller 6 to be delivered to the paper receiving portion 7.

Thus, it has become possible to achieve both paper setting and paper feeding through predetermined steps of procedure using one motor 51. This greatly contributes to the provision of smaller apparatus as compared with printers using two motors for performing these operations. In addition, since only one motor 51 is required the cost of parts can be reduced.

Figure 3:
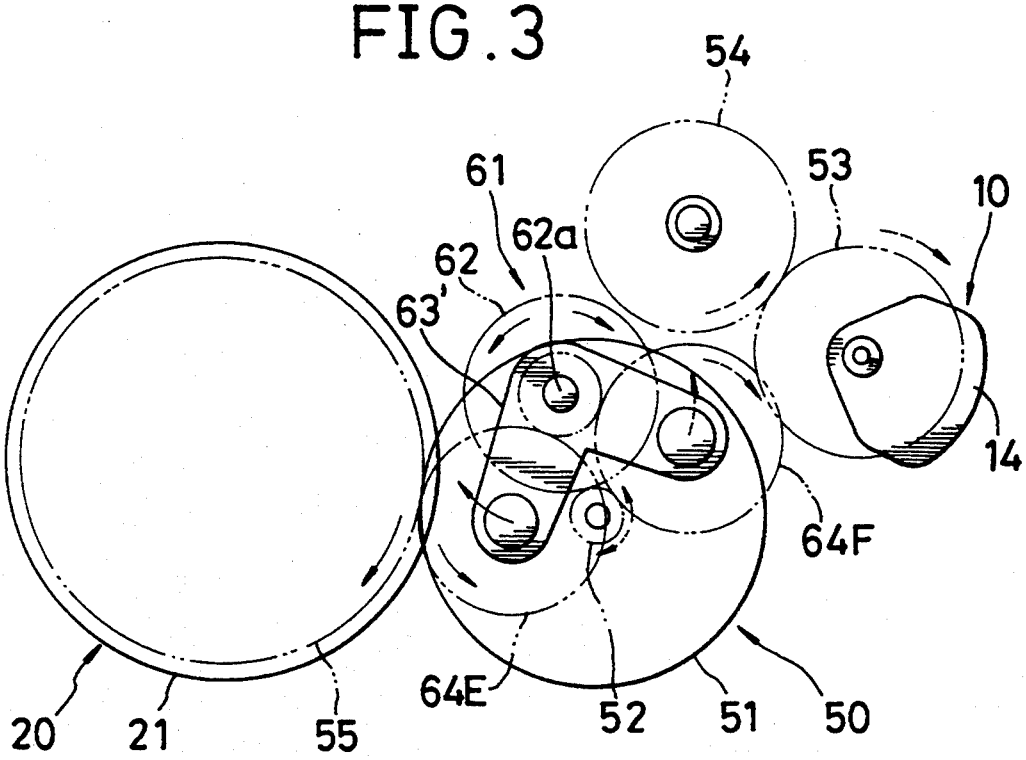
FIG. 3 is a side view showing a variation of the drive gear mechanism.

A variation of the selective power transmission portion 61 in the drive gear mechanism 50 will be described below with reference to FIG. 3. This drive gear mechanism 50, as shown in FIG. 3, is formed of a sun gear 62, a swing member 63' in the shape of the letter V supported for swinging round the same axis 62*a* as that of the sun gear 62 and adapted to be urged in the same direction as the rotating direction of the sun gear 62 by its rotating power, and planet gears 64E and 64F supported for rotation at the end portions of the swing member 63' in engagement with the sun gear 62. Thus, the swinging of the swing member 63' in either direction selectively causes the planet gear 64E to engage the paper feeding gear 55 or the planet gear 64F to engage the intermediate gear 54.

Namely, when the motor 51 is rotated in the normal direction and the pinion gear 52 is rotated clockwise, the sun gear 62 is rotated counterclockwise. Thereby, the swing member 63' is swung counterclockwise so that the planet gear 64E is disengaged from the paper feeding gear 55 and the planet gear 64F is engaged with the intermediate gear 54. As a result, the rotating power of the motor 51 is transmitted to the cam member 14 and the cam member 14 is rotated clockwise. Conversely, when the motor 51 is rotated in the reverse direction and the pinion gear 52 is rotated counterclockwise, the swing member 63' is swung clockwise so that the planet gear 64F is disengaged from the intermediate gear 54 and the planet gear 64E is engaged with the paper feeding gear 55. As a result, the rotating power of the motor 51 is transmitted to the feed roller 21 and feed roller 21 is rotated clockwise.

Thus, in the case of the drive gear mechanism 50 shown in FIG. 3, the quantity of swing of the swing member 63' is extremely small and therefore the selective transmission, and cut off, of the rotating power to the cam member 14 or the feed roller 21 is performed quickly.

Figure 4:
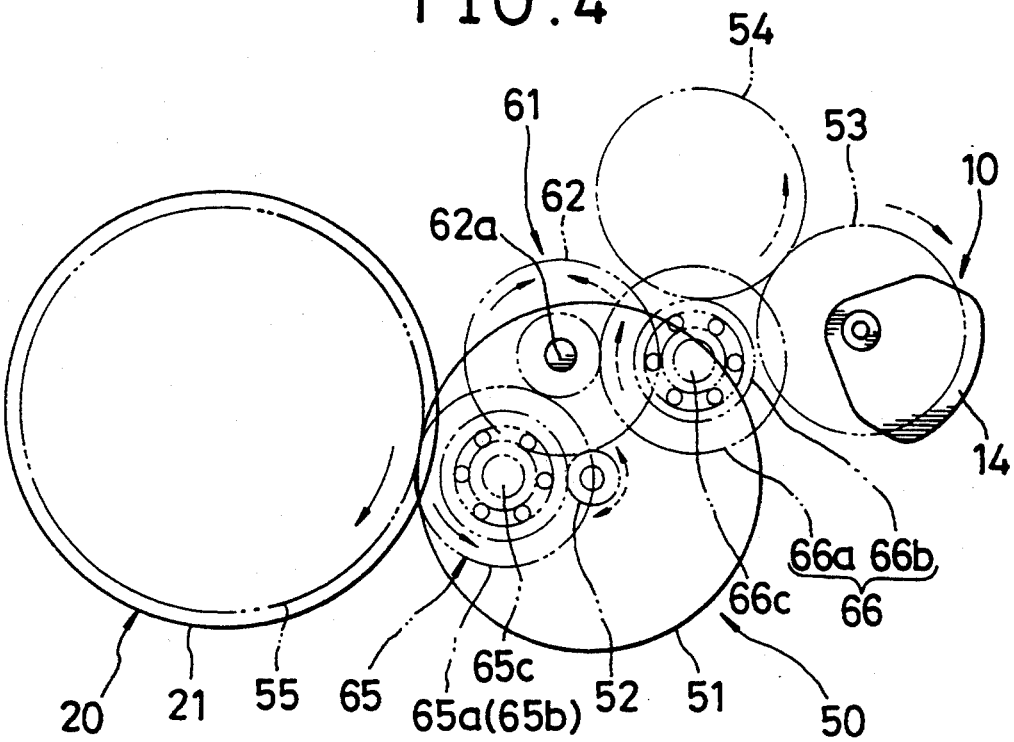
FIG. 4 is a side view of a drive gear mechanism showing a second embodiment of the present invention.

Second embodiment of the invention will be described below with reference to FIG. 4, in which corresponding parts to those in the first embodiment are denoted by corresponding reference numerals and description of the same will be omitted here. (The same rule will be applied to all of the following embodiments.) In this embodiment, two one-way gears 65 and 66 are used as the selective power transmission portion 61 of the drive gear mechanism 50. More specifically, the selective power transmission portion 61 is formed of a sun gear 62, a paper feeding one-way gear 65 coupling the sun gear 62 and the paper feeding gear 55, and a paper setting one-way gear 66 coupling the sun gear 62 and an intermediate gear 54.

The paper feeding one-way gear 65 is arranged so as to transmit the rotating power to the paper feeding gear 55 when the sun gear 62 is rotated clockwise in FIG. 4 (the same rule applies in the following), and not to transmit the rotating power to the paper feeding gear 55 when the sun gear 62 is rotated counterclockwise. More specifically, the paper feeding one-way gear 65 is formed of two gears 65*a* and 65*b* of the same diameter mounted on a support axis 65*c* and coupled with each other through a one-way clutch. The gear 65*a* is engaged with a small gear of the sun gear 62 and the gear 65*b* is engaged with the paper feeding gear 55. The gear 65*a* is adapted to be locked when the sun gear 62 is rotated clockwise and to rotate simultaneously with the gear 65*b*. Thereby, the paper feeding gear 55 is rotated clockwise. Since the gear 65*a* is adapted to be unlocked and rotated idly when the sun gear 62 is rotated counterclockwise, the rotating power is not transmitted to the paper feeding gear 55 and hence the paper feeding gear 55 remains in its state stopping the rotation.

The paper setting one-way gear 66 is arranged so as to transmit the rotating power to the intermediate gear 54 only when the sun gear 62 is rotated counterclockwise and does not transmit the rotating power when the sun gear 62 is rotated clockwise. More specifically, the paper setting one-way gear 66 is formed of two gears 66*a* and 66*b* mounted on a support axis 66*c*. The gear 66*a* is engaged with a small gear of the sun gear 62 and the gear 66*b* is engaged with the intermediate gear 54. The gear 66*a* is adapted to be locked when the sun gear 62 is rotated counterclockwise and to rotate simultaneously with the gear 66*b*. Thereby, the cam member 14 is rotated clockwise. Since the gear 66*a* is adapted to be unlocked and rotated idly when the sun gear 62 is rotated clockwise, the rotating power is not transmitted to the paper setting gear 54 and hence the cam member 14 remains in its state stopping the rotation.

With the described arrangement, when the motor 51 is rotated in the normal direction, the sun gear 62 of the selective power transmission portion 61 is rotated counterclockwise through the pinion gear 52. Thereby, the rotating power of the motor 51 is transmitted to the cam member 14 and the cam member 14 is rotated clockwise. When the motor 51 is rotated counterclockwise, the sun gear 62 is rotated clockwise. Thereby, the rotating power of the motor 51 is transmitted to the feed roller 21 and hence the feed roller 21 is rotated clockwise.

Thus, the paper setting operation and paper feeding operation through predetermined steps of procedure are performed by one motor 51 and hence the object to make the entire apparatus smaller is attained. Further, since the selective power transmission portion 61 is constituted of two one-way gears 65 and 66, the control of the number of revolutions of the feed roller 21 and the control of the position of the paper tray 11 can be performed more accurately and shifting in power transmission between the paper setting mechanism 10 and the paper feeding mechanism 20 can be performed more quickly. This contributes to achievement of faster printing.

A third embodiment of the present invention will be described below with reference to FIG. 5. In this embodiment, the selective power transmission portion 61 of the drive gear mechanism 50 is formed of one one-way gear and one planet gear mechanism. Since the one-way gear is of the same structure as that of the paper feeding one-way gear 65 described in the second embodiment, parts thereof will be denoted by corresponding reference numerals and description of the same will be omitted.

Figure 5:
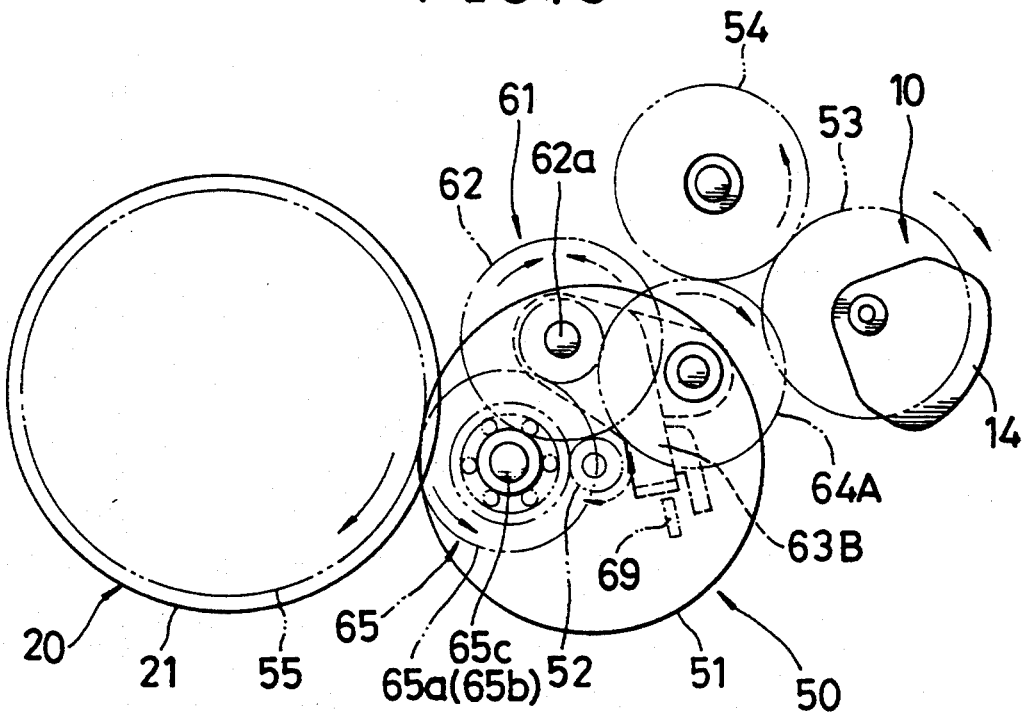
FIG. 5 is a side view of a drive gear mechanism showing a third embodiment of the present invention.

The selective power transmission portion 61, as shown in FIG. 5, is formed of a sun gear 62, a paper feeding one-way gear 65 for coupling the sun gear 62 and the paper feeding gear 55, a swing member 63B swingably supported by the same axis 62*a* as that of the sun gear 62 and urged in the same direction as the rotating direction of the sun gear 62, a planet gear 64A rotatably supported by the end portion of the swing member 63B so as to engage the sun gear 62, and a stopper 69 for controlling the swinging of the swing member 63B from exceeding a predetermined angle in the clockwise direction.

With the described arrangement, if the motor 51 is rotated in the normal direction, the sun gear 62 of the selective power transmission portion 61 is rotated counterclockwise through the pinion gear 52. Thereby, the rotating power of the motor 51 is transmitted to the cam member 14 through the planet gear mechanism (formed of members 62, 63B, 64A, 69, etc.) and the cam member 14 is rotated clockwise. If the motor 51 is rotated in the reverse direction, the sun gear 62 is rotated clockwise. Thereby, the rotating power of the motor 51 is transmitted to the feed roller 21 through the paper feeding one-way gear 65 and the feed roller 21 is rotated clockwise.

Accordingly, the same as in the first embodiment and the second embodiment, the paper setting and feeding operations through predetermined steps of procedure can be achieved by one motor 51 and the provision of smaller-sized apparatus and reduction in the cost of parts can be attained. Further, since the selective power transmission portion 61 is formed of one one-way gear 65 and one planet gear mechanism (formed of members 62, 63B, 64A, 69, etc.), switching of the power transmission to the paper feeding mechanism 20 can be performed quickly.

Although, it is arranged in the above embodiment such that transmission and cut off of the power to the cam member 14 of the paper setting mechanism 10 is performed by the planet gear mechanism (formed of members 62, 63B, 64A, 69, etc.), while transmission and cut off of the power to the feed roller 21 of the paper feeding mechanism 20 is performed by the one-way gear 65, it may conversely be arranged such that transmission and cut off of the power to the cam member 14 is performed by a one-way gear 65 and transmission and cut off of the power to the feed roller 21 is performed by the use of a gear mechanism of the same structure as that of the planet gear mechanism (formed of members 62, 63B, 64A, 69, etc.).

A fourth embodiment of the present invention will be described with reference to FIG. 6 to FIG. 10. In this embodiment, the paper setting mechanism 10 is unitized and the feed roller 21 and the paper tray 11 are both divided into divisions. More specifically, the feed roller 21 is divided into three feed rollers 21A, 21B, and 21C disposed at regular intervals. Further, the paper tray 11 is divided into two paper tray forming portions 12A and 12B which are independently rotatable round the fulcrum 12. The paper tray forming portions 12A and 12B are made of a synthetic resin and disposed side by side along the shaft of the fulcrum 12. Each of the paper tray forming portions 12A and 12B has a roller-contacted portion 12*s*, a cam-contacted surface 11*c*, a fulcrum bearing portion 12*d*, etc.

Figure 6:
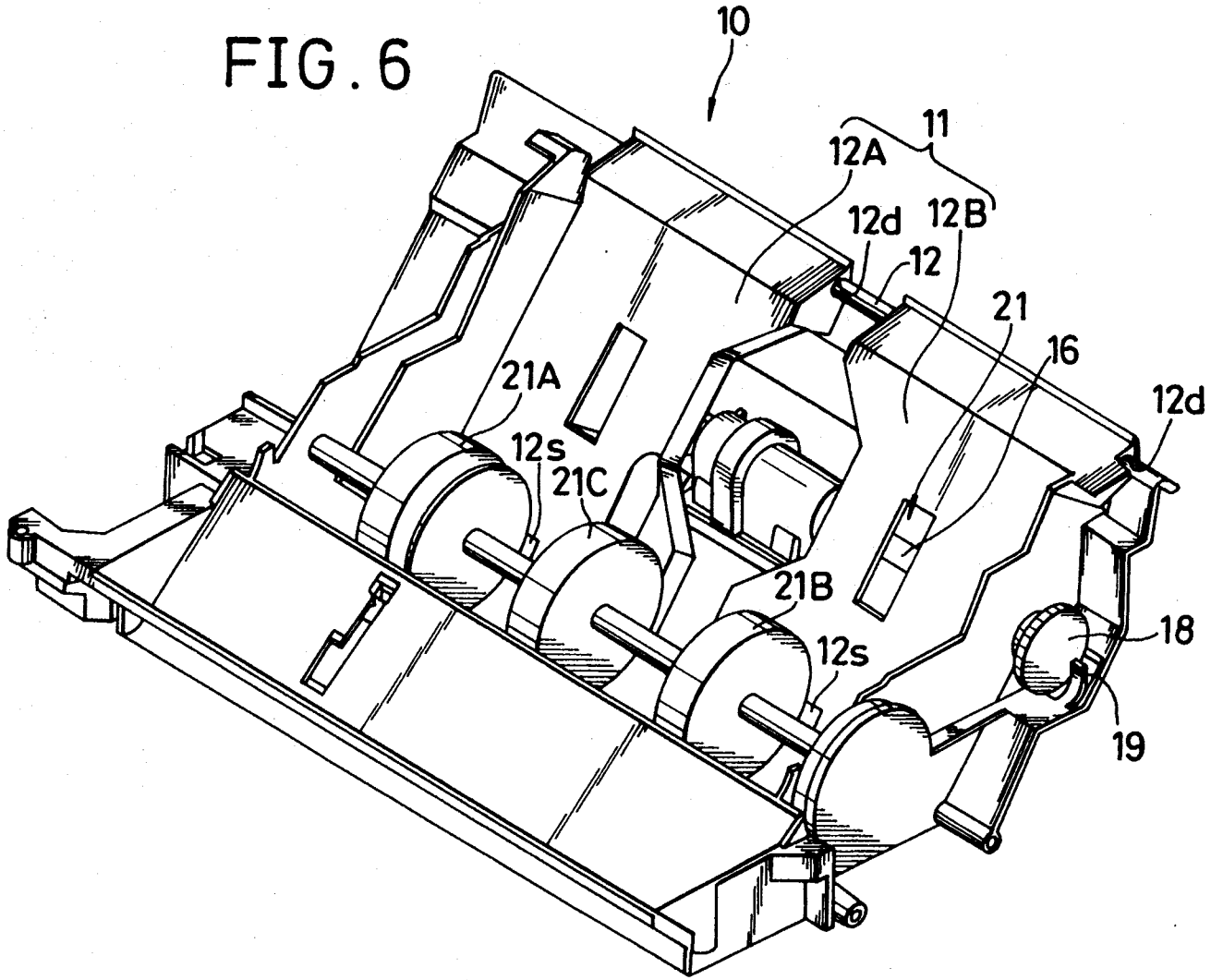
FIG. 6 is a perspective view showing the whole of a fourth embodiment of the present invention.
Figure 7:
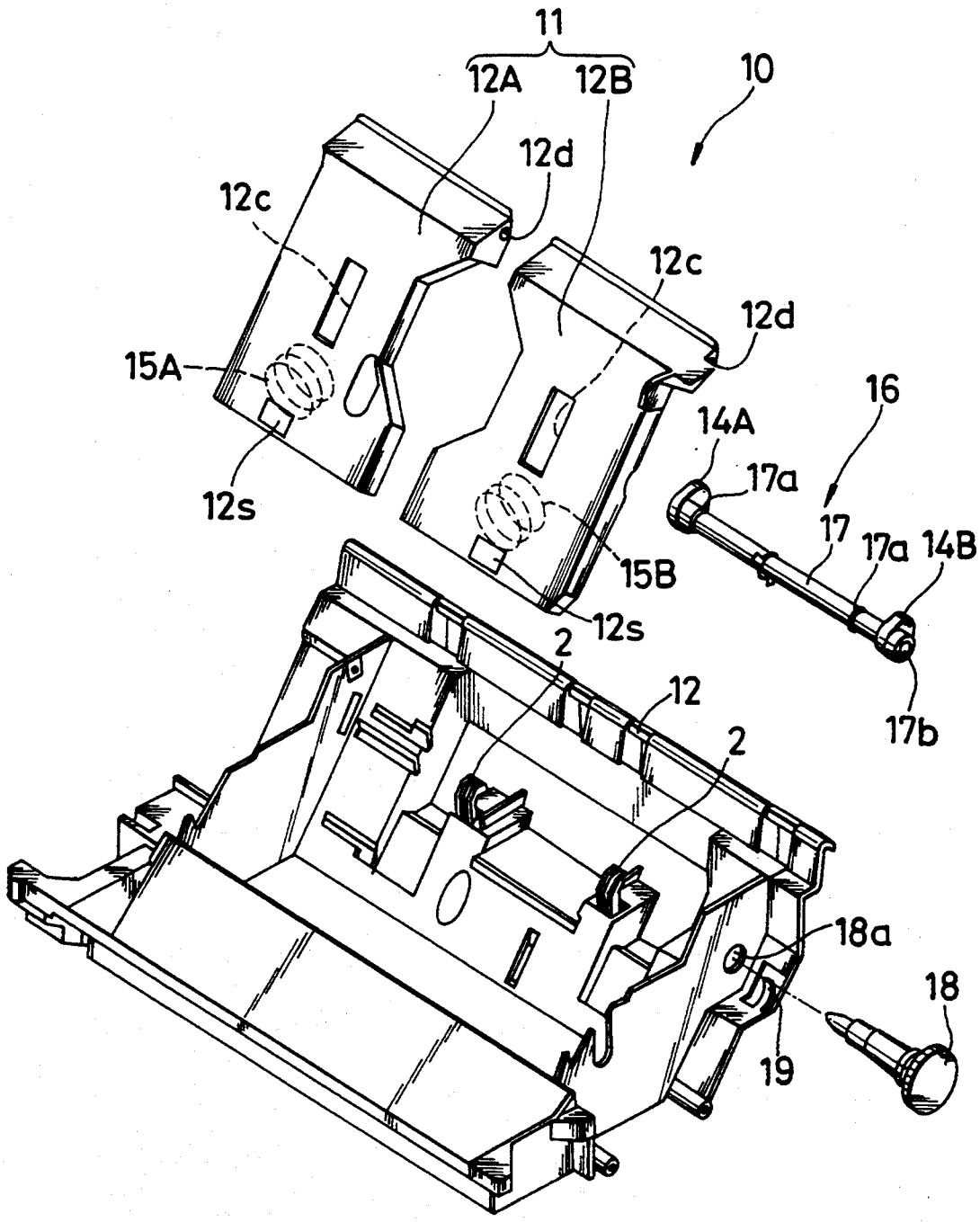
FIG. 7 is an exploded perspective view showing a paper tray and means for raising/lowering the paper tray.
Figure 8:
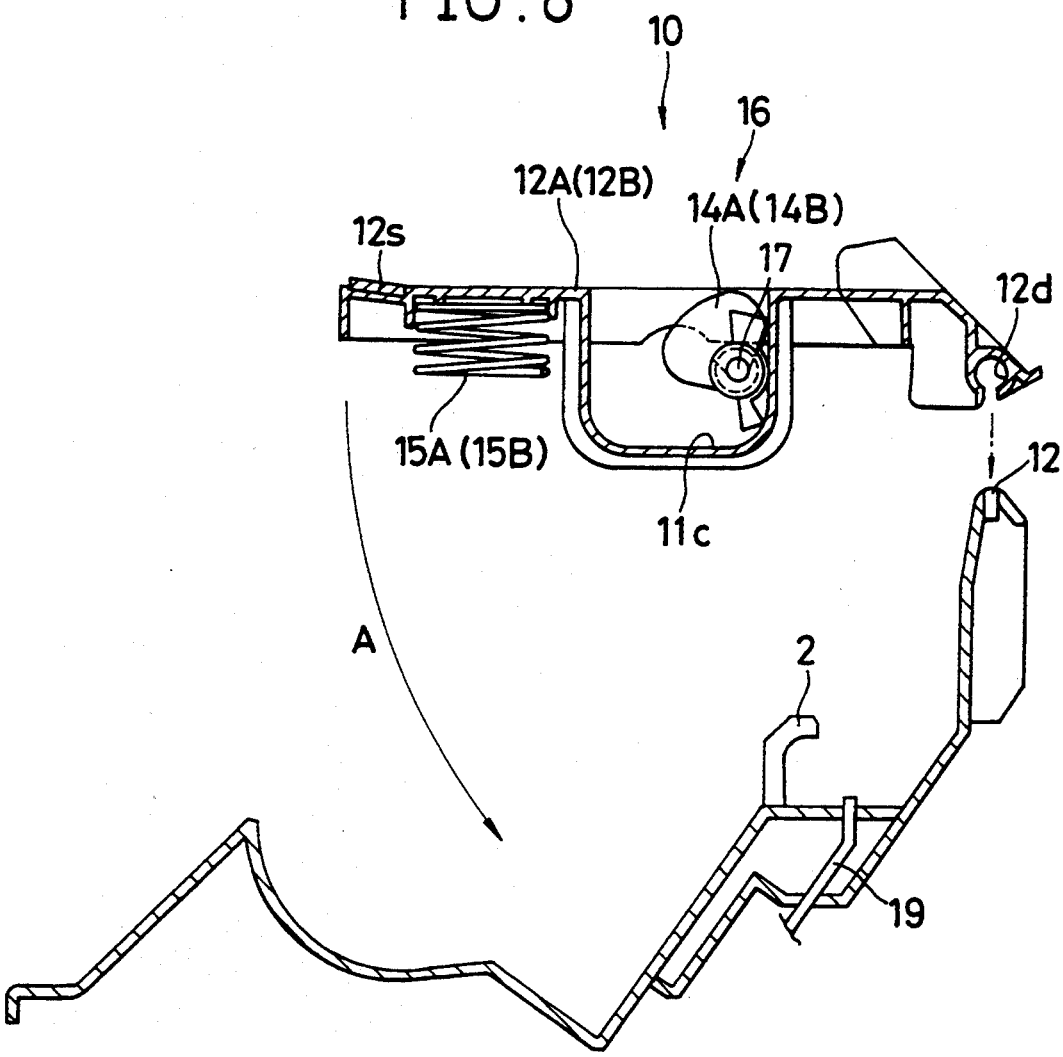
FIG. 8 is a side view in longitudinal section showing a process for fixing the paper tray and a cam device of the means for raising/lowering the paper tray to the body.

The roller-contacted portion 12*s* of each of the paper tray forming portions 12A and 12B is the portion coming into contact with each of the left and right feed roller 21A and 21B in FIG. 6 when the paper feeding position is determined, and the area of it is made as small as possible. Each roller-contacted portion 12s is finished into a plane surface and provided with cork having a high friction coefficient attached thereto. Since the area of the roller-contacted portion 12s is small, the area to be finished into a plane surface is small, which makes the finishing work easier. Each cam-contacted surface 11c is formed integral with each of the paper tray forming portions 12A and 12B.

The paper setting mechanism 10 includes the two paper tray forming portions 12A and 12B, two springs 15A and 15B pressing the paper tray forming portions 12A and 12B against the feed rollers 21A and 21B, and a cam device 16 for separating the paper tray forming portions 12A and 12B from the feed rollers 21A and 21B against the resilient force of the springs 15A and 15B. More specifically, the springs 15A and 15B are attached at their one end to predetermined positions on the rear side of the paper tray forming portions 12A and 12B for pressing the paper tray forming portions 12A and 12B against the feed rollers 21A and 21B with the same pressure.

The cam device 16 is formed of cam members 14A and 14B which engage the cam-contacted surfaces 11c of the paper tray forming portions 12A and 12B and causes the paper tray forming portions 12A and 12B to rotate to thereby keep the paper tray forming portions 12A and 12B in retreated positions from the feed rollers 21A and 21B, a cam shaft 17 coupling the cam members 14A and 14B, a drive mechanism including a cam gear 18 for driving the cam shaft 17 to rotate, of which the whole is not shown, and the cam-contacted surfaces 11c formed in the paper tray forming portions 12A and 12B in positions where the same engage the cam members 14A and 14B. More specifically, the cam members 14A and 14B are mounted on both end portions of the cam shaft 17. The cam shaft 17 is provided with rings 17a disposed in predetermined positions thereof for position control of itself. At right-hand end of the cam shaft 17 in FIG. 7, there is formed a connection hole 17b for connecting the cam shaft 17 with the cam gear 18. In predetermined positions on the side of the unitized paper setting mechanism 10, there are formed a pair of cam bearings 2 for rotatably supporting the cam shaft 17. On the side of the printer body 1, an insertion hole 18a for inserting the cam gear 18 therethrough is formed and, in the vicinity of the insertion hole 18a, there is formed a locking claw 19.

Figure 9:
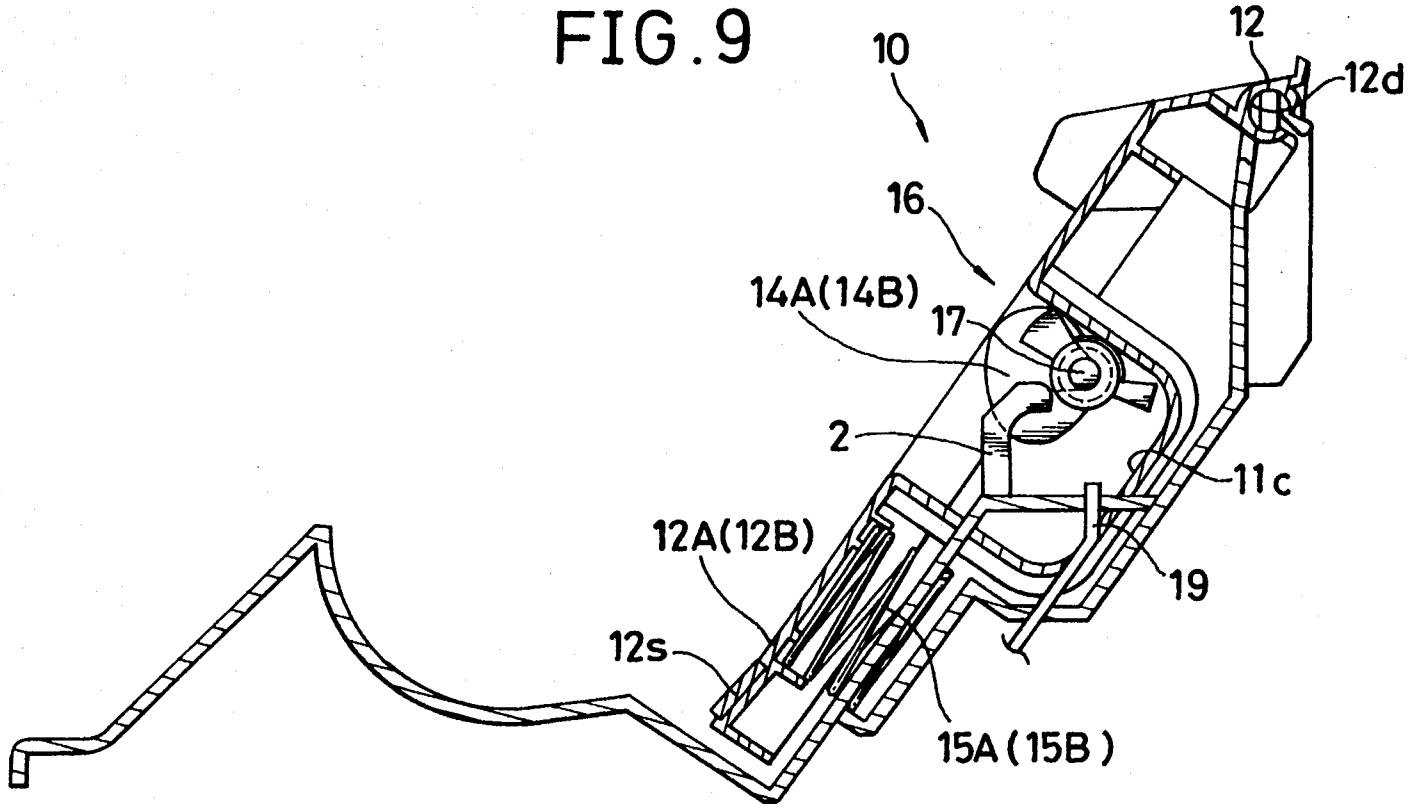
FIG. 9 is a side view in longitudinal section showing a process for fixing the paper tray and a cam device of the means for raising/lowering the paper tray to the body.
Figure 10:
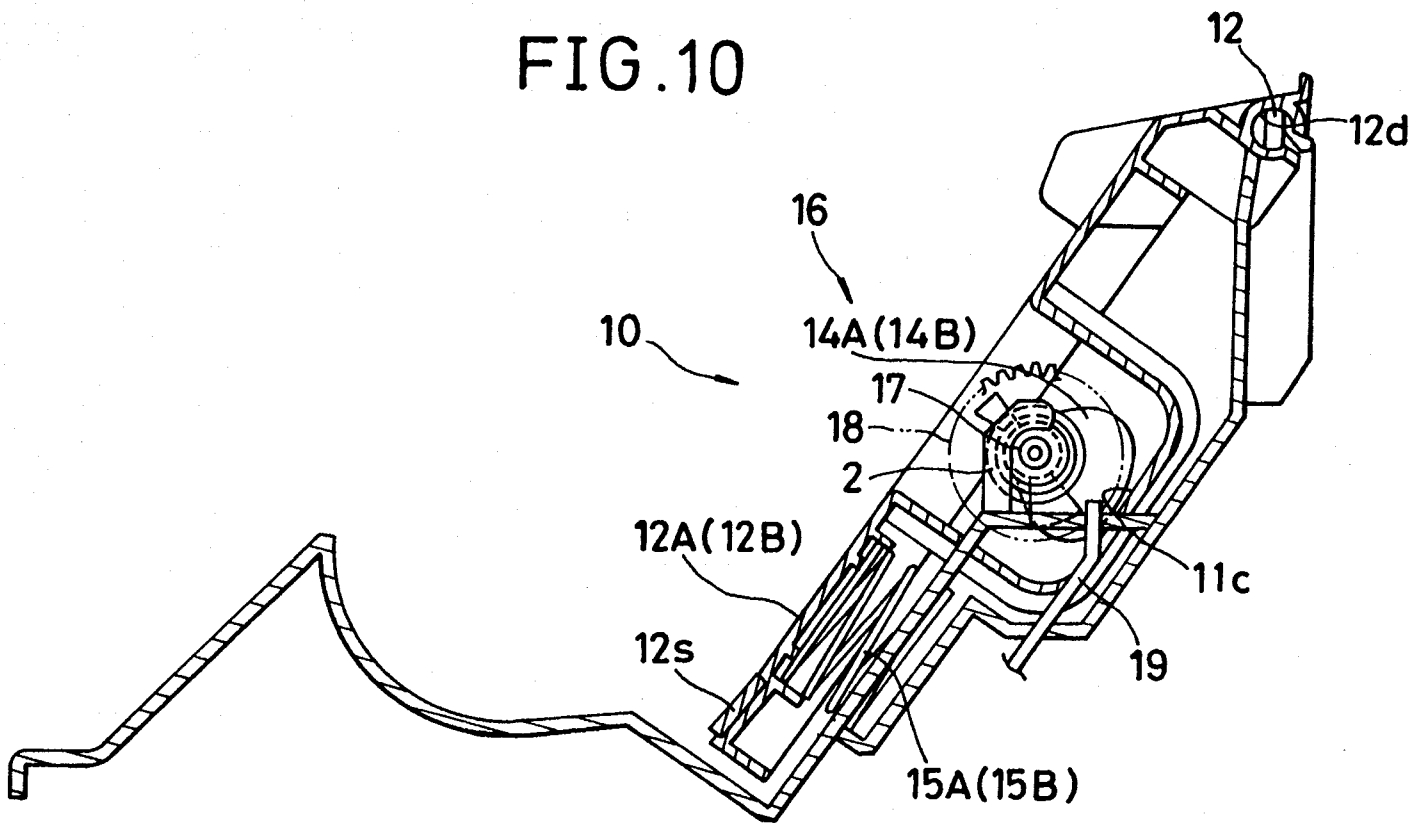
FIG. 10 is a side view in longitudinal section showing a process for fixing the paper tray and a cam device of the means for raising/lowering the paper tray to the body.

Steps of procedure for incorporating the paper tray 11 and the cam device 16 into the unitized paper setting mechanism 10 will be described below. First, the paper tray forming portions 12A and 12B are mounted on the fulcrum 12 with fulcrum bearing portions 12d arranged side by side. Then, the paper tray forming portions 12A and 12B are rotated in the direction of the arrow A in FIG. 8 (as shown in FIG. 9) and the cam shaft 17 is brought into engagement with the cam bearings 2 such that the cam shaft 17 is restricted in axial movement by the rings 17a (as shown in FIG. 10). After the paper tray forming portions 12A and 12B have thus been mounted on the paper setting mechanism 10, the cam gear 18 is inserted through the insertion hole 18a with the engagement claw 19 bent and the same is put into the connection hole 17b in the cam shaft 17 so as to be fixed thereto. Thereby, the cam gear 18 is prevented from coming off by the elastic restoring force of the engagement claw 19.

With the described arrangement, the paper tray forming portions 12A and 12B are moved simultaneously and thereby the topmost copy paper of the sheets of paper mounted on the paper tray forming portions 12A and 12B comes in contact with the teed rollers 21A, 21B, and 21C. Accordingly, as the feed rollers 21 rotate, the topmost copy paper is fed out of the paper tray 11.

In this case, though the paper tray 11 is made of a synthetic resin, and not made of a specially high rigid material (such as an aluminum die casting), it is hardly deformed because it is divided in two members of the paper tray forming portions 12A and 12B and each thereof is short in the direction parallel to the axis of the fulcrum 12. Thus, it does not deform even if it is pressed against the feed roller 21 or the like with a predetermined pressure. Therefore, it does not occur that the topmost copy paper of the paper held in the paper tray 11 unevenly abuts on the feed roller 21 or the like and that the paper moves forward obliquely. Further, since the feed roller 21 is divided into pieces, the roller-contacted portions 12s formed on the paper tray forming portions 12A and 12B are not required to be made long in the direction parallel to the axis of the fulcrum 12 and hence the area to be finished into plane surface in forming the roller-contacted portions 12s becomes smaller and hence the work for the formation becomes easier. Therefore, while smooth feeding of the copy paper out of the paper tray 11 is achieved, the costs for parts and fabrication can be reduced.

What is claimed is:

1. A paper feeding apparatus for a printer, comprising:

a feed roller, said feed roller being a constituent of a paper feeding mechanism, adapted to come into abutment with the topmost paper held in a paper holding portion of a paper tray for feeding the topmost paper in said paper holding portion to a paper feeding path;

a fulcrum for rotatively supporting said paper tray;

a paper setting mechanism, said paper setting mechanism including said paper tray, said paper tray having said paper holding portion for holding plural sheets of paper, said paper setting mechanism having means for rotating said paper tray so that said paper holding portion of said paper tray is moved toward, and away from, said feed roller;

a single motor rotatable both in normal and reverse directions and serving as the drive source of said paper setting mechanism and said feed roller;

drive control means for selectively controlling said single rotor to rotate either in the normal direction or in the reverse direction; and a drive gear mechanism for selectively transmitting the normal or reverse rotation of said single motor either to said paper setting machanism or to said paper feeding mechanism, wherein said drive gear mechanism includes a sun gear to which the rotating power of said single motor is transmitted, a swing arm attached to the same axis as that of said sun gear for swinging in accordance with the rotation of said single motor, a planet gear rotatably attached to the swinging end portion of said swing arm and normally engaged with both said sun gear and one of a gear portion on the side of said paper setting mechanism and a gear portion on the side of said feed roller, and a one-way gear normally engaged with both said sun gear and the other of one of said gear portion on the side of said paper setting mechanism and said gear portion on the side of said feed roller.

2. The paper feeding apparatus for a printer according to claim 1, wherein said paper tray is divided into a plurality of paper tray forming portions independently rotatable about said fulcrum and said paper setting mechanism causes said paper tray forming portions to move toward, and away from, said feed roller simultaneously.

3. The paper feeding apparatus for a printer according to claim 1, wherein said feed roller is divided into a plurality of pieces arranged side by side in the axial direction thereof.

4. A paper feeding apparatus for a printer, comprising:

a feed roller, said feed roller being a constituent of a paper feeding mechanism, adapted to come into abutment with the topmost paper held in a paper holding portion of a paper tray for feeding the topmost paper in said paper holding portion to a paper feeding path;

a paper setting mechanism, said paper setting mechanism including said paper tray, said paper tray having said paper holding portion for holding plural sheets of paper, said paper setting mechanism having means for rotating said paper tray so that said paper holding portion of said paper tray is moved toward, and away from, said feed roller;

a fulcrum for rotatively supporting said paper tray;

a single motor rotatable both in normal and reverse directions and serving as the drive source of said paper setting mechanism and said feed roller;

drive control means for selectively controlling said single motor to rotate either in the normal direction or in the reverse direction; and a drive gear mechanism for selectively transmitting the normal or reverse rotation of said single motor either to said paper setting mechanism or to said paper feeding mechanism, wherein said drive gear mechanism includes a selective engagement gear selectively engaged either with a gear portion on the side of said paper setting mechanism or with a gear portion on the side of said feed roller, a selection mechanism for selectively engaging said selective engagement gear either with said gear portion on the side of said paper setting mechanism or with said gear portion on the side of said feed roller, and a power transmission mechanism for transmitting the rotating power of said single motor to said selective engagement gear, wherein said power transmission mechanism includes a sun gear to which the rotating power of said single motor is transmitted, said selection mechanism includes a swing arm attached to the same shaft as that of said sun gear for swinging in accordance with the rotation of said sun gear, and said selective engagement gear includes a planet gear rotatably attached to the swinging end portion of said swing arm and normally engaged with said sun gear, and wherein said swing arm has bifurcated swinging end portions and to each of said swinging end portions a said planet gear is attached.

5. The paper feeding apparatus for a printer according to claim 4, wherein said paper tray is divided into a plurality of paper tray forming portions independently rotatable about said fulcrum and said paper setting mechanism causes said paper tray forming portions to move toward, and away from, said feed roller simultaneously.

6. The paper feeding apparatus for a printer according to claim 4 wherein said feed roller is divided into a plurality of pieces arranged side by side in the axial direction thereof.

7. A paper feeding apparatus for a printer, comprising:

a feed roller, said feed roller being a constituent of a paper feeding mechanism, adapted to come into abutment with the topmost paper held in a paper holding portion of a paper tray for feeding the topmost paper in said paper holding portion to a paper feeding path;

a paper setting mechanism, said paper setting mechanism including said paper tray, said paper tray having said paper holding portion for holding plural sheets of paper, said paper setting mechanism having means for rotating said paper tray so that said paper holding portion of said paper tray is moved toward, and away from, said feed roller;

a fulcrum for rotatively supporting said paper tray;

a single motor rotatable both in normal and reverse directions and serving as the drive source of said paper setting mechanism and said feed roller;

drive control means for selectively controlling said single motor to rotate either in the normal direction or in the reverse direction; and a drive gear mechanism for selectively transmitting the normal or reverse rotation of said single motor either to said paper setting mechanism or to said paper feeding mechanism, wherein said drive gear mechanism includes a selective engagement gear selectively engaged either with a gear portion on the side of said paper setting mechanism or with a gear portion on the side of said feed roller, a selection mechanism for selectively engaging said selective engagement gear either with said gear portion on the side of said paper setting mechanism or with said gear portion on the side of said feed roller, and a power transmission mechanism for transmitting the rotating power of said single motor to said selective engagement gear, and wherein said power transmission mechanism includes a sun gear to which the rotating power of said single motor is transmitted and said selection mechanism and said selective engagement gear include, on one side, a first one-way gear normally engaged with both said sun gear and said gear portion on the side of said paper setting mechanism and, on the other side, a second one-way gear of which the rotation transmitting direction is opposite to that of said first one-way gear and which is normally engaged with both said sun gear and the gear portion on the side of said feed roller.

8. The paper feeding apparatus for a printer according to claim 7, wherein said paper tray is divided into a plurality of paper tray forming portions independently rotatable about said fulcrum and said paper setting mechanism causes said paper tray forming portions to move toward, and away from, said feed roller simultaneously.

9. The paper feeding apparatus for a printer according to claim 7, wherein said feed roller is divided into a plurality of pieces arranged side by side in the axial direction thereof.

* * * * *